United States Patent [19]

Beyl

[11] 4,081,186

[45] Mar. 28, 1978

[54] SAFETY SKI BINDING

[76] Inventor: Jean Joseph Alfred Beyl, Boulevard Victor Hugo, Nevers, Nievre, France

[21] Appl. No.: 650,745

[22] Filed: Jan. 20, 1976

[30] Foreign Application Priority Data

Jan. 28, 1975 France ..... 75 02536
Apr. 2, 1975 France ..... 75 10224

[51] Int. Cl.[2] ..... A63C 9/08

[52] U.S. Cl. ..... 280/618; 280/623; 280/627; 280/628; 280/631

[58] Field of Search ..... 280/618, 617, 616, 628, 280/629, 630, 631, 632, 634, 611, 614, 623, 626

[56] References Cited

U.S. PATENT DOCUMENTS

| | | | |
|---|---|---|---|
| 3,241,849 | 3/1966 | Bodycomb | 280/623 |
| 3,326,567 | 6/1967 | Pronzati | 280/628 |
| 3,476,401 | 11/1969 | Unger | 280/628 |
| 3,594,014 | 7/1971 | Salomon | 280/628 |
| 3,689,095 | 9/1972 | Salomon | 280/628 |
| 3,866,928 | 2/1975 | Gertsch et al. | 280/618 |
| 3,900,205 | 8/1975 | Sittmann | 280/618 |
| 3,942,809 | 3/1976 | Sittmann | 280/618 |

FOREIGN PATENT DOCUMENTS

| | | | |
|---|---|---|---|
| 1,392,812 | 8/1965 | France | 280/626 |

*Primary Examiner*—Joseph F. Peters, Jr.
*Assistant Examiner*—Milton L. Smith
*Attorney, Agent, or Firm*—Bierman & Bierman

[57] ABSTRACT

A safety ski binding comprising a detachable, pivotally-mounted plate for clamping the ski boot at the toe and heel ends thereof, and toe-end and heel-end devices for releasably holding said plate to the ski. The heel-end device essentially comprises a lock-bolt pivotally mounted to a case pivoting in turn about a pivot member rigid with, and perpendicular to, the top ski surface. The pivot axis of this lock bolt is perpendicular to said pivot member and parallel to the top ski surface, and extends across the longitudinal axis of the ski. This arrangement further comprises resilient means enclosed in said case and adapted to retain both said lock bolt in relation to said pivoting case and said pivoting case in relation to its pivot member in their normal operative position.

23 Claims, 21 Drawing Figures

XVII
XVII
47i
41i
4i
40i
48i
101i
60i
61i
45i
50i
21i
2i
6i
3i
93i
94i
95i

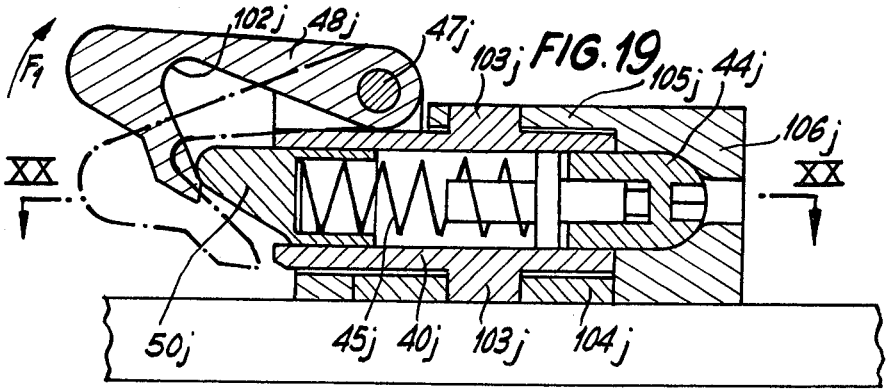
FIG. 19
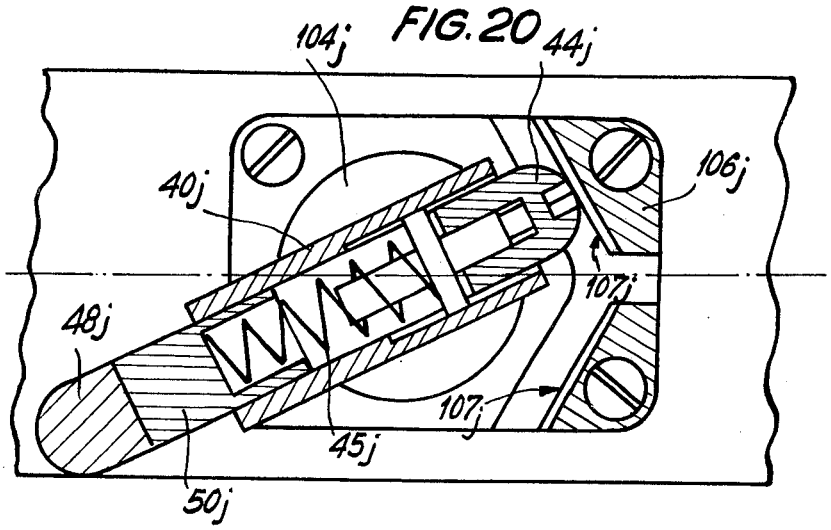
FIG. 20
FIG. 21
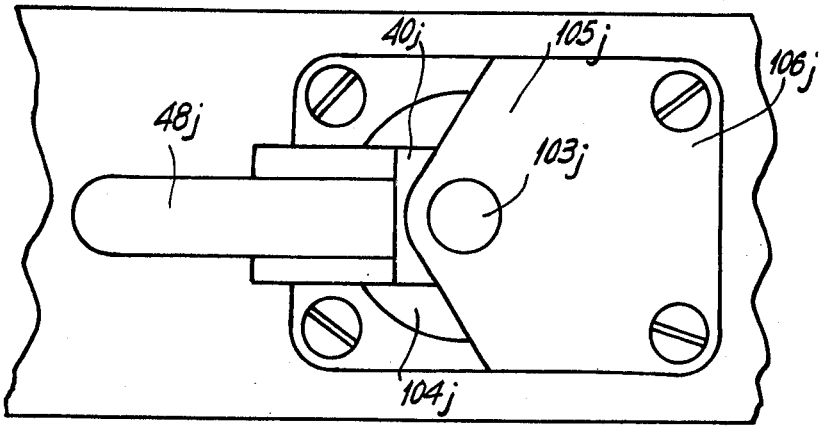

SAFETY SKI BINDING

BACKGROUND OF THE INVENTION

1. Field of the Invention

The present invention relates to a safety ski binding comprising a plate means for releasably retaining the ski boot through the medium of front and rear retaining means, said plate means being mounted to be rotatable and longitudinally moveable about a central pivot member in a plane parallel to the ski. More particularly, the present invention is concerned with a safety ski binding of the type broadly set forth hereinabove wherein the plate, releasable from the ski, is normally retained thereon at its toe and heel ends by locking devices rigidly secured to the ski. At least one of these devices, preferably the one located adjacent the heel end of the plate, will comprise a tilting lock bolt adapted to engage a slideway formed in said plate. Resilient means constantly urge said tilting lock bolt in its normal position on the ski while permitting plate release movement in all directions in relation to the top surface of the ski.

2. Description of the Prior Art

A safety ski binding of this general type is disclosed, for instance in the German Patent DT-OS 2,321,816 filed Apr. 30, 1973 by Gertsch AG. To avoid the detrimental effects generated by ski flexion, the binding plate is retained vertically by resiliently urged locking members. However, the ski boot and therefore the skier's leg is safely released under excessive torsional stress conditions due to the rotational movement of the plate about a central pivot member because at least one of the resilient locking members can slide along a concave cam member extending across the ski axis. Nevertheless, in this instance, a problem notable where torsional release is attended by, or requires a relatively long release stroke, arises from the fact that a correspondingly long relative movement must take place along a guideway disposed externally and free of any protection against snow, weather conditions and shocks. Moreover, the normal position of the plate on the ski cannot be determined with the desired degree of precision unless the locking member engages a central notch or cavity formed in said cam member. With this latter arrangement, it is hardly possible to obtain a constant torque during the torsional release of said plate.

German Patent Application DT-OS 1,678,246 filed Mar. 18, 1968 by Uber and Hoehne discloses a safety ski binding incorporating a plate which is preferably mounted for pivotal movement at its front or toe end and at its rear or heel end is retained by a bolt or finger of the locking device. The bottom of this bolt or finger has a part-spherical configuration and bears within a case against a piston urged by resilient means, the lever arm ratios of the device for releasing the ski boot under torsion stress and in case of forward fall being determined through different constructional dimensions of the width and height of the base or bottom portion of said finger or bolt. It is evident that manufacturing a device of this character, especially with a part-spherical base or bottom of said lock bolt or finger, involves a relatively complicated operation.

SUMMARY OF THE INVENTION

It is the essential object of the present invention, on the basis of the safety ski binding of the well-known long-stroke, spring-loaded release piston type mentioned hereinabove and disclosed notably in the German Patent DT-PS 1,201,737, filed Dec. 18, 1968 by Jean Joseph Alfred Beyl, applicant herein, to provide an improved ski binding of the type mentioned in the preamble of this specification, which is designed for releasing the ski boot under both lateral torsional stress and excessive vertical stress.

To solve this problem, the present invention provides in a safety ski binding of the type mentioned at the beginning of this specification, a lock bolt for releasably holding the detachable plate, which bolt is pivotally mounted on a case pivoting in turn about a pivot member rigid with the ski and perpendicular to the top surface of the ski. The pivot axis of this lock bolt, which is perpendicular to said pivot member of said case, is parallel to the top surface of the ski and extends across the longitudinal axis of the ski. The arrangement further comprises means enclosed in said case which are adapted, in their normal position, to retain both said lock bolt in relation to said pivoting case and said pivoting case in relation to its pivot member rigid with the ski.

The lock bolt is pivoted about a pivot axis perpendicular to the pivot member of said pivoting case, and resilient means are operative both between this lock bolt and said case, and between said case and its pivot member rigid with the ski, so that all release movements can be obtained in a constructionally simple manner by means of the lock bolt proper, without resorting to any guideway of particular contour between the detachable plate and this lock bolt.

In a preferred form of embodiment of the safety ski binding according to the present invention, the resilient means disposed on the one hand between said lock bolt and the pivoting case, and on the other hand between said pivoting case and the pivot member thereof, comprise spring-loaded piston means resiliently urged against a bearing surface and adapted to generate substantially constant return forces.

BRIEF DESCRIPTION OF THE DRAWINGS

FIG. 19 is a longitudinal section showing another form of embodiment of the device for retaining the heel end of the movable plate of this invention;

FIG. 20 is a horizontal section showing the same device, the section being taken along the line XX—XX of FIG. 19, this device being shown during the pivotal movement of the case associated with the tilting lock bolt, resulting from torsional stress release movement, and FIG. 21 is a plan view from above of the same device.

DESCRIPTION OF THE PREFERRED EMBODIMENTS

Figure 1:
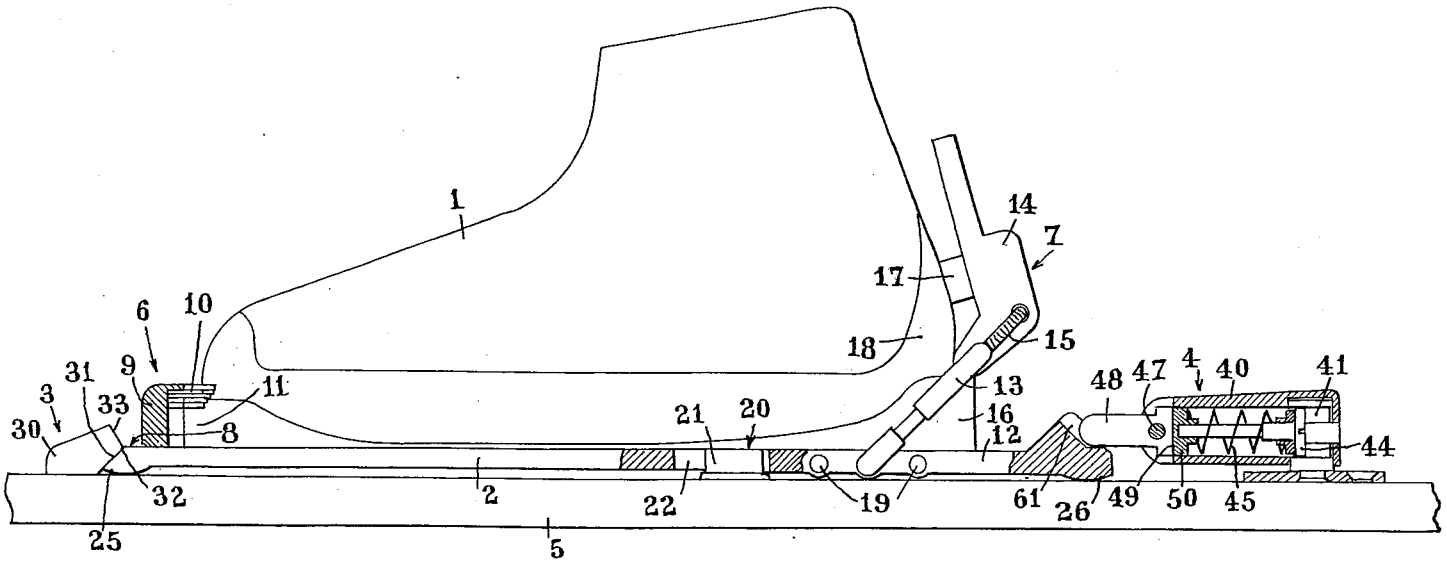
FIG. 1 illustrates diagrammatically in side-elevational and part-sectional view a safety ski binding constructed according to the teachings of this invention.
Figure 2:
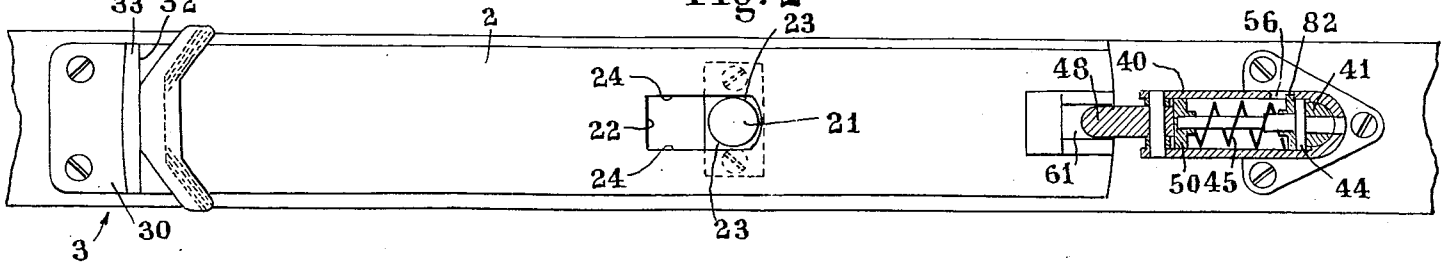
FIG. 2 is a plan view from above with parts broken away of the device shown in FIG. 1, without the ski boot.

Referring first to FIGS. 1 to 5 of the drawings, the safety ski binding illustrated therein comprises a plate 2 adapted to be detached from the ski and to receive a ski boot 1 thereon. This plate 2 is retained on the ski 5 in a manner known per se by means of a toe locking device 3 and a heel locking device 4. The ski boot 1 is connected to the plate 2 by means of a sole-clamping device 6 and a heel hold-down device 7.

The sole clamping device 6 comprises a rigid jaw 9 mounted to the front end 8 of plate 2 and adapted to engage the toe end 11 of the ski boot 1 by means of side arms 10. The inner face of each arm 10, i.e. the face registering with the toe end of the ski boot, is inclined or formed with steps so as to adapt itself automatically to the height of the sole 11. In fact, this arrangement affords an accurate vertical positioning of the arms 10 as a function of the thickness or height of the sole 11.

The heel hold down device 7 comprises, in a manner known per se, pivoted arms 13 disposed on the rear portion 12 of plate 2 and, on either side of the boot heel, these arms 13 carry a retaining lever 14. Front lower projection 15 of retaining level 14, engages the rear end 16 of the ski boot while an intermediate abutment member 17, of retaining lever 14 engages the rear portion 18 of the boot upper. The arms 13 are adjustable to different lengths in order to adapt them to various boot sizes. For a first or approach adjustment according to the boot length, these arms 13 may be engaged in selected ones of various spaced holes 19 formed laterally in plate 2. Thus, the boot 1 is safely yet releasably connected to the plate 2 by means of the two retaining devices 6 and 7.

Under normal skiing conditions, the plate 2 is held on the ski 5 by a central pivot member 20 and the locking devices 3 and 4. The central pivot member 20 is rigid with the ski and comprises a cylindrical projection 21 and a shank (not shown) screwed in to the ski 5. This cylindrical projection 21 engages an elongated opening 22 formed in plate 2. More particularly, its rounded lateral faces are in constant contact with the lateral sides 24 of said opening 22, which are parallel to the main longitudinal axis of the ski 5. However, opening 22 is longer than than the diameter of said cylindrical projection 21 in the longitudinal direction of the ski, such that the plate 2 can move longitudinally while being held against movement across the ski axis. Of course, the plate 2 can also pivot about said projection 21. However, the plate 2 is not held down by the central pivot member 20, and thus can move upwards away from the ski surface. On the other hand, the plate 2 does not bear on the ski surface throughout its length but only through the medium of a pair of transverse convex ribs formed underneath. One rib 25 is located at the toe end 8 of the plate and the other 26 is located at the heel end 12 so that the plate can easily slide on the ski surface. With this arrangement and due to the specific design of the central pivot member 20, the plate 2 is constantly independent of any flexion movements of the ski 5.

The front or toe end locking device 3 associated with the plate 2 comprises an abutment member 30 secured to the ski by means of screws and provided with an inclined bearing surface 31 extending across the ski axis. This bearing surface is engaged by a corresponding surface 32 formed on the toe end of plate 2. As clearly apparent from FIG. 2, the registering and co-acting bearing surfaces 31 and 32 are slightly curved with a radius of curvature corresponding to the distance between these surfaces and the axis of the central pivot member 20 of the plate 2, so as to avoid any interference with the lateral release movement of said plate 2. The bearing surface 31 of abutment member 30 comprises a upper, cut-off corner portion 33 providing an insertion surface of which the specific function will be described presently with reference to FIG. 3 together with the description of the mode of operation of the ski binding.

The heel locking device 4 associated with plate 2 comprises a case 40 mounted for pivotal movement in a plane parallel to the ski surface by means of a pivot member 41 perpendicular to the ski surface and rigid with the ski 5. This pivot member engages a blind hole 42 formed in said case 40 and comprises a front bearing surface 43 engageable by a first piston 44 urged by a coil compression spring 45 housed in a longitudinal bore 46 of said case 40.

Pivotally mounted at the front end of case 40 is a lock bolt 48 adapted to pivot about a pivot pin 47. This pivot pin 47 extends at right angles to the pivot member 41 of case 40 and across the longitudinal axis of the ski. The lock bolt 48 comprises a rear bearing surface 49 engaged by another piston 50 slidably fitted in the longitudinal bore 46 of case 40 and urged by the same coil compression spring 45 away from the first piston 44.

This first piston 44 reacting on the other hand against the front bearing surface 43 of pivot member 41 comprises a rod 51 guided at its free end 52 in a cavity 53 of the other piston 50. This piston rod 51 comprises a screw-threaded portion 54 adapted to receive a nut 55. As clearly shown in FIGS. 2 and 4 this nut 55 carriers an integral lateral stud 82 engaging a lateral aperture 56 formed in case 40 to prevent the nut 55 from rotating in relation to this case 40. The pivot member 41 further comprises a hole 58 aligned with a corresponding aperture 59 formed in the rear end of case 40, whereby the user can insert a screwdriver through these aligned apertures for engaging a control groove 57 formed in piston 44. Thus, when the piston 44 is thus rotated, the nut 55 can move longitudinally along the rod 51 of piston 44 to modify in one or the other way the force of spring 45. The position of nut 55 is visible from the outside through said lateral aperture 56.

The front end of lock bolt 48 normally engages a slideway 61 formed on the rear or heel end 12 of plate 2. This slideway 61 consists of an oblique groove extending upwardly and rearwardly in the longitudinal direction of the ski. The front end of lock bolt 48 engages the side walls 83 of this groove 61. In the example illustrated in FIGS. 1 to 5, the bottom of this groove comprises a section 62 parallel to the ski surface, which merges into another section 63 extending upwardly and forwardly. However, if desired the section 62 parallel to the ski surface may be omitted from this groove 61.

Figure 6:
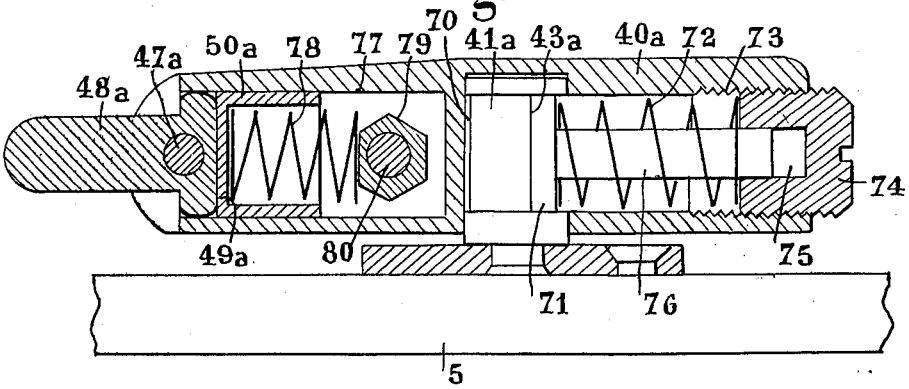
FIGS. 6 and 7 are sectional views showing two other forms of embodiment of this locking device.
Figure 7:
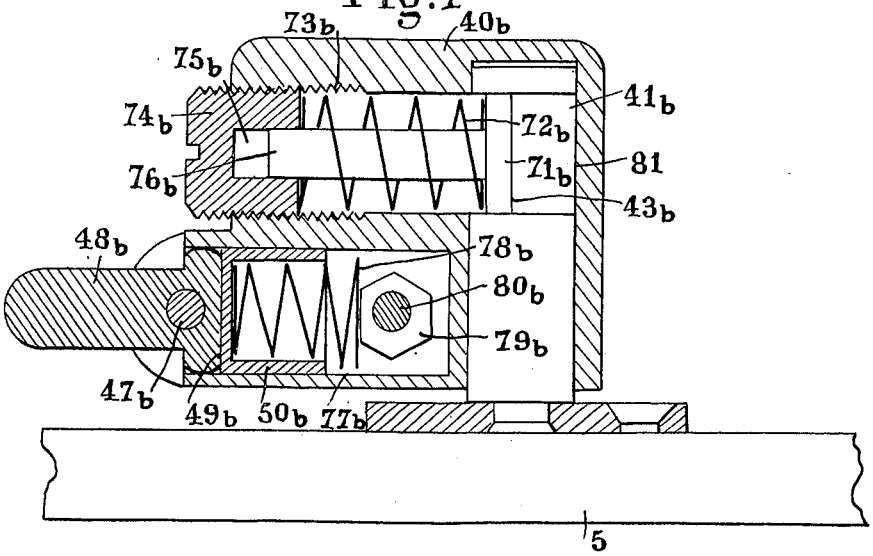

In the forms of embodiment of the locking device 4 shown in FIGS. 6 and 7 of the drawings, the parts and elements corresponding to those of the preceding form of embodiment are designated by the same reference numerals except that the index "*a*" or "*b*" is added, respectively. The essential difference between these modified forms of embodiment and the structure described hereinabove lies in the fact that separate resilient means are provided for controlling the lock bolt **48*a* or 48*b*, and the pivotal movement of case 40*a* or 40*b* about its pivot member 41*a* or 41*b***, respectively.

In the form of embodiment shown in FIG. 6 the resilient means are disposed tandemwise in the longitudinal direction of the ski. The pivot member **41*a* engages a blind hole 70 located substantially centrally of the pivoting case 40*a*. The piston 71 reacting against the bearing surface 43*a* of pivot member 41*a* is urged by a coil compression spring 72 housed in a bore 73 formed in the rear portion of case 40A. This spring 72 reacts at its rear end against a screw plug 74. In another longitudinal bore 77 formed in the front portion of case 40*a* another coil compression spring 78 is housed and reacts with one end against the bearing surface 49*a* of lock bolt 48*a*. Lock bolt 48*a* is pivoted to pivot pin 47*a*. The opposite end of coil compression spring 78 bears against a bearing member 79 permitting the adjustment of the force of spring 78. This bearing member 79 consists essentially of a prismatic body carried by a shaft 80 rotatably mounted in the case 40*a* and having its geometrical axis somewhat off-set in relation to the axis of said prismatic body. Thus, when this bearing member is rotated about its axis, the initial stress of spring 78** can be modified at will.

The form of embodiment illustrated in FIG. 7 departs from that shown in FIG. 6 only in that the resilient means, i.e. the springs **72*b* and 78*b*, are enclosed in corresponding superposed bores 73*b* and 77*b* of the case 40*b*. Therefore, the corresponding and similar components of FIG. 6 are designated in FIG. 7** by the same reference numerals to which the index letter *b* is added. As a consequence to the superposition of the two resilient means the pivot member **41*b* is longer and the blind hole 81** is deeper.

Figure 3:
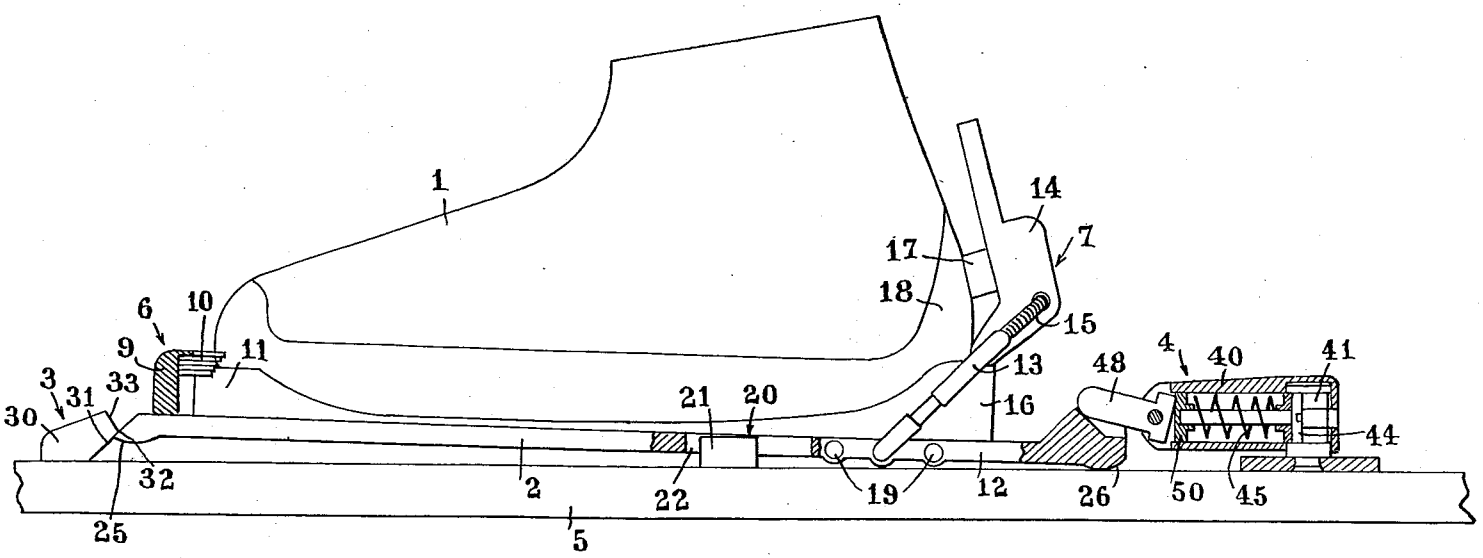
FIG. 3 is a view similar to FIG. 1 but showing a position assumed by the plate before its engagement or its release from the rear or heel end.
Figure 4:
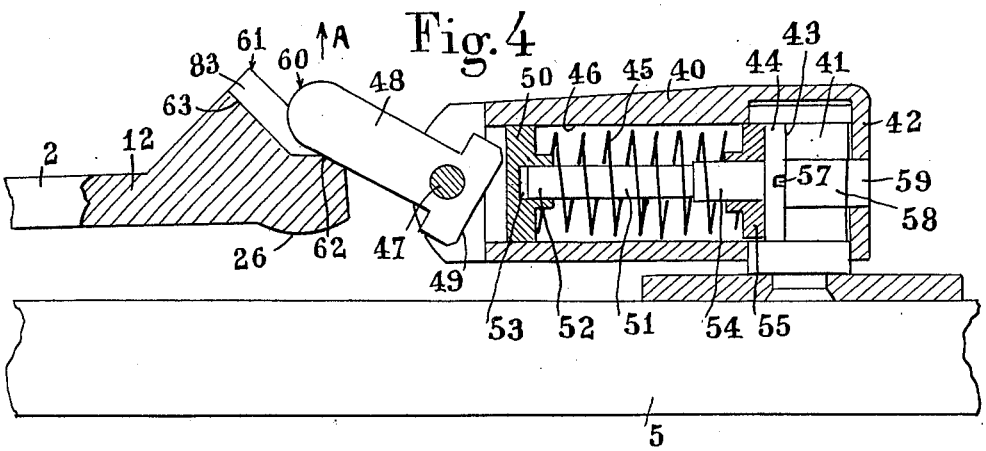
FIG. 4 is a sectional view showing on a larger scale, the heel locking device during a vertical release movement.
Figure 5:
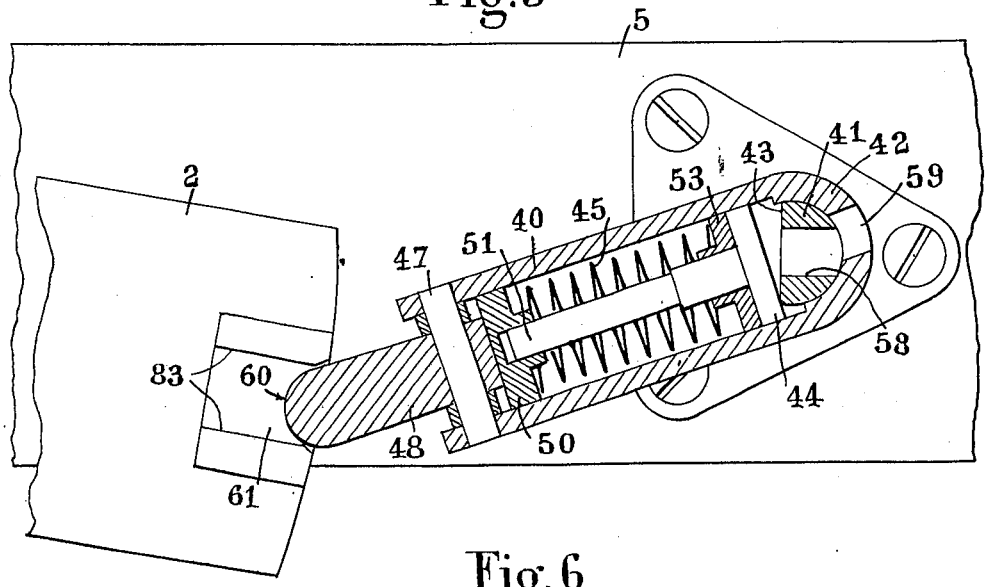
FIG. 5 is a plan view with a horizontal section showing the heel locking device during a lateral torsional release movement of the plate.

The safety ski binding according to this invention operates as in the form of embodiment illustrated in FIGS. 1 to 5, and notably in FIGS. 3 to 5. When the user has fitted and locked the ski boot 1, in the manner already known per se and by means of the retaining or locking devices 6 and 7 on the plate 2, the plate is locked in turn to the ski 1 in the manner illustrated in FIG. 3. In fact, this plate 2 is slidably moved to the rear in order to bring its slideway 61 beneath the lock bolt 48. Lowering the toe end of the ski boot will cause the front edge of the surface 32 of plate 2 to slide along the insertion surface 33 until said surface 32 is in locking engagement with the bearing surface 31 of locking device 3. Thus, the plate 2 is positioned as shown in FIG. 1. It will be seen that the front end 60 of lock bolt 48 is then positioned above the bottom of slideway 61.

A movement opposite the above-described boot-fitting movement takes place when a rearwardly directed force is exerted on the boot. In this case, the plate 2 may move rearwardly if this force is sufficient to cause the front end 60 of lock bolt 48 to slide along the oblique section 63 of slideway 61, this sliding movement being attended by the tilting of said lock bolt 48 in the clockwise direction, as seen in FIGS. 3 and 4. However, this tilting movement of lock bolt 48 is counteracted by the force of spring 45 tending to prevent a tilting movement of the bearing surface 49 of said lock bolt 48 in relation to piston 50. If the application of this rearwardly directed force is protracted, it eventually releases the front bearing surface 32 of plate 2 from the bearing surface 31 of the front locking device 3.

In case of forward fall, the release movement is thus produced, i.e. when tractive efforts are exerted in the upward direction on the rear portion 12 of plate 2, as shown by the arrow A in FIG. 4. Thus the lock bolt 48 is forced to tilt about its pivot pin 47. This movement is attended by an angular movement of bearing surface 49 in relation to piston 50. The release torque may be adjusted by modifying the force of spring 45. When the force acting in the direction of the arrow A is maintained for a certain time, the front end 60 of lock bolt 48 is eventually released from the slideway 61.

The torsional plate release movement is illustrated more particularly in FIG. 5. In this case the plate 2 can rotate in a plane parallel to the top surface of the ski about the central pivot member 20, the side walls 24 of aperture 22 of plate 2 sliding on the curved surfaces of the cylindrical projection 21. This rotational movement is counteracted by the rear or heel locking device 4 with an adjustable release force, and the piston 44 is thus caused to pivot in relation to the bearing surface 43 of pivot member 41, as illustrated in FIG. 5. This release force is provided by the adjustable prestress of spring 45. When a torsional stress of sufficient duration is exerted, the tip 60 of lock bolt 48 eventually moves out from slideway 61 to release the plate with the ski boot thereon. Of course, the tilting bolt 48 acts as a rigid transmission member during these torsional release movements.

In all the forms of embodiments and modes of operation contemplated herein the locking device 4, i.e. the lock bolt 48 and case 40, resume their initial or normal position subsequent to the disengagement of the tip 60 of lock bolt 48 from slideway 61 and to the complete release of plate 2. Then the locking device 4 is ready for another boot-fitting and clamping operation as described hereinabove with reference to FIG. 3.

Figure 9:
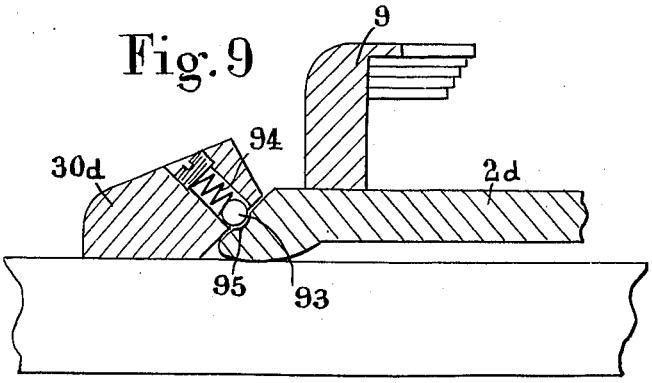
FIG. 9 is a section taken along the line IX—IX of FIG. 8.
Figure 8:
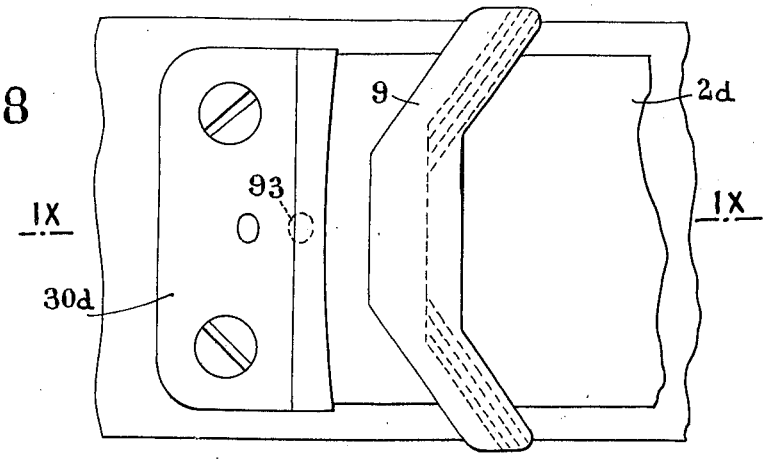
FIG. 8 is a plan view from above of a modified form of embodiment of the device for retaining the toe end of the detachable plate.

FIGS. 8 and 9 illustrate a modified form of embodiment of the abutment member for retaining the toe end of plate 2. In this alternate form of embodiment the corresponding abutment member 30d comprises a thrust ball 93 responsive to a spring 94 and adapted to engage a recess 95 formed in the central area of the toe end of the relevant plate 2d.

This spring-loaded ball device is thus capable of taking up any lateral play resulting from the assembly clearance between the central pivot member and plate 2d.

Figure 10:
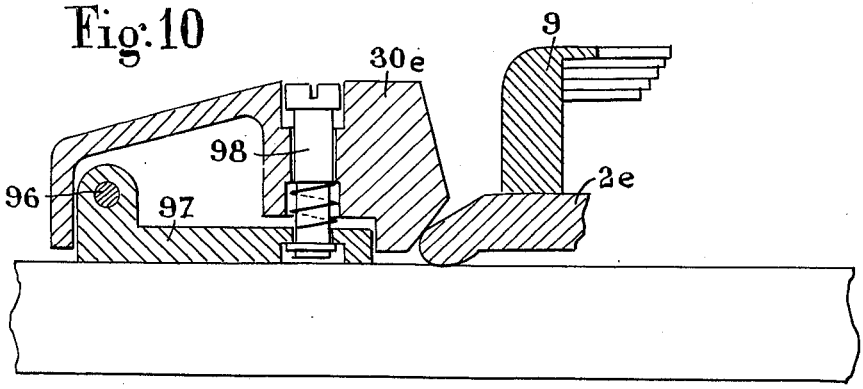
FIG. 10 is a longitudinal axial section showing another modified form of embodiment of the device for retaining the toe end of the detachable plate.

FIG. 10 illustrates another modified form of embodiment of the toe locking device, shown with the plate actually retained thereby. In this modified structure, the body 30e of the relevant locking device is pivotally mounted about a horizontal pivot pin 96 carried by a base plate 97 adapted to be rigidly secured to the top surface of the ski. On the other hand, this body 30e is connected to this base plate 97 by means of a screw 98 to permit the adjustment of the vertical position of said body in relation to the top surface of the ski.

Therefore, this position may be adjusted for retaining the toe end of the corresponding releasable or detachable plate 2e under the best possible conditions.

Figure 11:
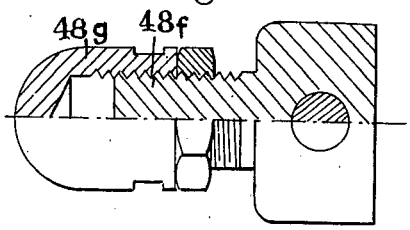
FIG. 11 illustrates in part-elevational, part-sectional view, a modified form of embodiment of the lock bolt.

FIG. 11 illustrates a modified form of embodiment of the lock bolt associated with the rear end of the detachable plate. In this alternate form of embodiment the lock bolt comprises two sections, namely a main body 48f and a tip 48g screwed thereon. Thus, the length of this lock bolt can be adjusted as required.

Figure 12:
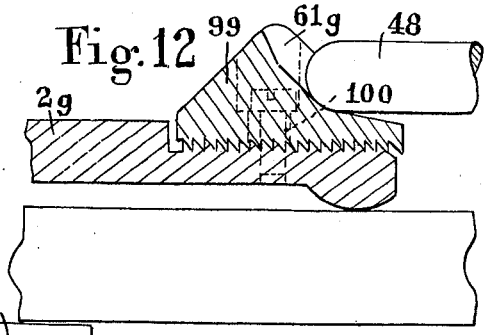
FIGS. 12 and 13 are fragmentary longitudinal sections of two modified forms of embodiment of the slideway engageable by the lock bolt of this safety ski binding.

FIG. 12 illustrates a modified form of embodiment of the slideway formed at the rear end of the corresponding detachable plate 2 and adapted to be engaged by the lock bolt 48. In this alternate construction the groove 61g of the relevant slideway is formed in an insert block 99 fitted to the corresponding end of plate 2g and secured thereto by means of a screw 100. However, the cavity formed in this insert block 99 for receiving this screw 100 has an elongated configuration with its major axis parallel to the ski axis, so that the position of the insert block 99 can be modified as desired in this direction.

With the two forms of embodiment illustrated in FIGS. 11 and 12 the user can vary at will the points where the detachable plate is retained on the ski, in order to compensate not only errors possibly committed when assembling some components of the ski binding, but also subsequent changes occurring in the ski camber.

Figure 13:
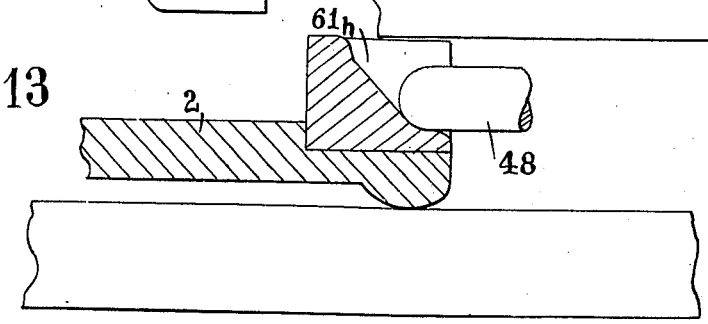
Figures 14, 15, 16:
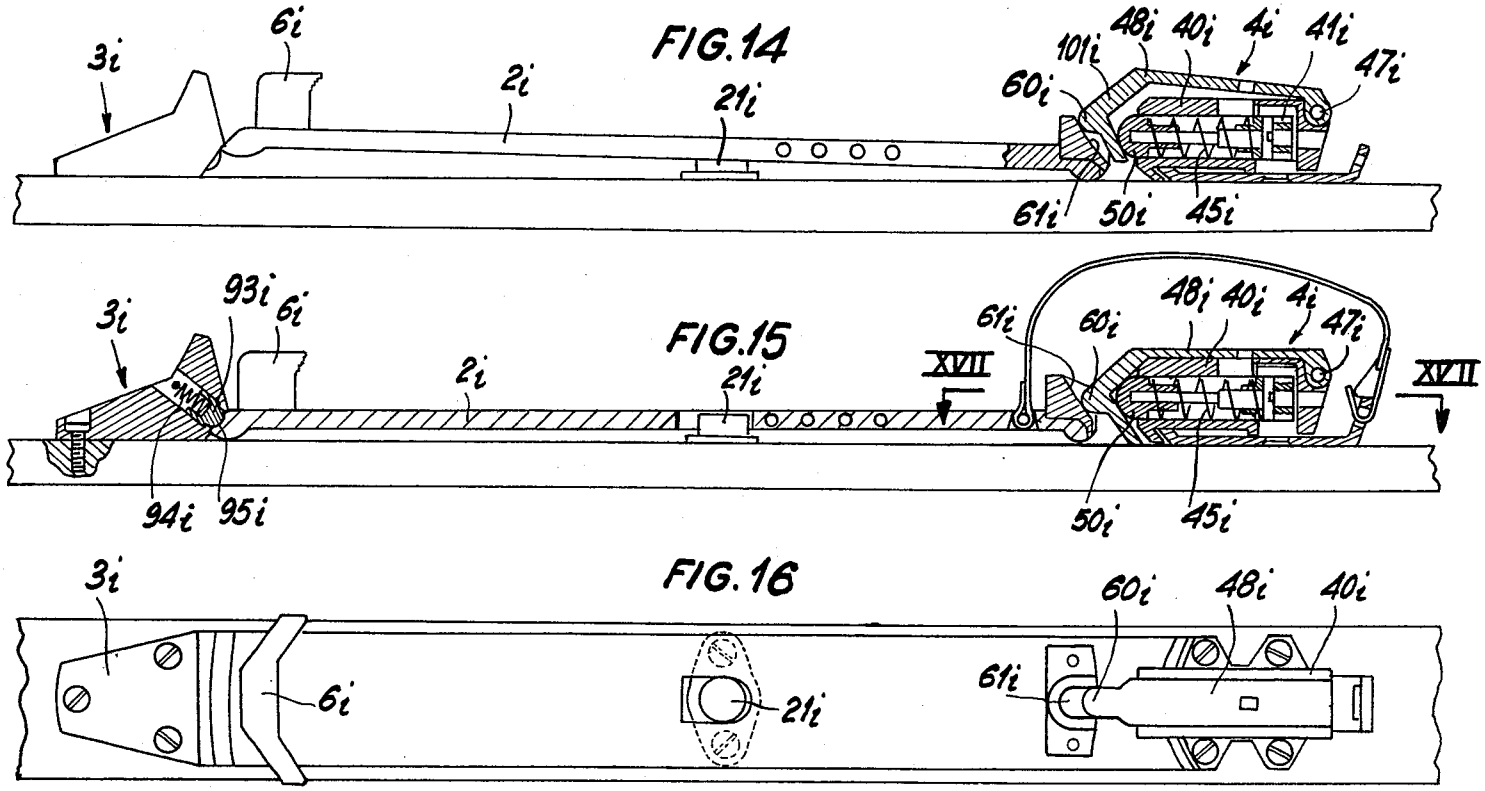
FIG. 14 is a side elevational view showing, with parts broken away, another form of embodiment of the ski binding of this invention, the movable plate being shown during the fitting of the plate to the ski top surface, or during its release in case of a backward fall of the skier.
FIG. 15 is a longitudinal sectional view of the same safety ski binding of which the movable plate is shown in its normal position on the ski.
FIG. 16 is a plan view from above of the same ski binding.
Figure 17:
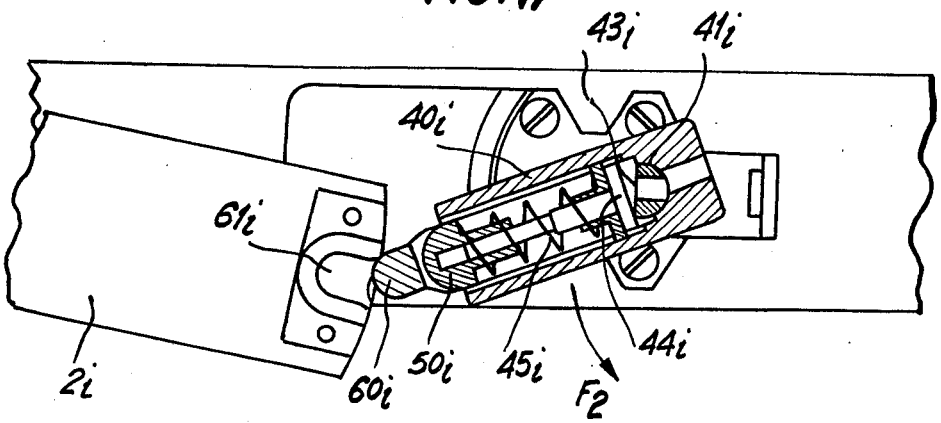
FIG. 17 is a fragmentary horizontal section taken along the line XVII—XVII of FIG. 15, illustrating the safety ski binding of this invention during a movement of rotation of the movable plate, namely a torsional release movement.

Finally, FIG. 13 shows a modified form of embodiment of the slideway provided at the heel end of the movable plate for receiving the corresponding lock bolt 48. In this construction the bottom of the groove portion 61h of this slideway has a profile differring somewhat from the one illustrated in FIGS. 1, 3 and 4.

FIGS. 14 to 18 illustrate another possible form of embodiment of this invention. In this modified structure a movable plate 2i adapted to receive the corresponding ski boot and detachable from the ski is pivotally mounted about a pivot member 21i rigid with the ski. At its toe end, this plate 2i carriers a sole clamping device 6i of the type already described hereinabove.

This safety ski binding is normally retained on the top surface of the ski by means of a pair of holding devices disposed at the toe end and heel end respectively and designated by the general reference symbols 3i and 4i. The toe end device 3i is of the same type as the one shown in FIG. 9 and thus comprises a ball or push member 93i responsive to a coil compression spring 94i and adapted to engage a cavity 95i formed at the front end of plate 2i.

On the other hand, the heel retaining device 4i differs from those described in the foregoing. In fact, instead of being pivoted to the front end of the pivoting case 40i of this heel device, as in the preceding forms of embodiment, the tilting lock member is pivotally mounted about a horizontal pivot pin 47i disposed across the rear portion of case 40i. Thus, this tilting member operates more as a lever than as a bolt. Besides, the length of this lever is such that it extends over the case 40i throughout the length thereof.

At its front end, this tilting lever comprises a portion 101i extending downwardly in front of the foremost portion of said case 40i. On its front face, this portion 101 comprises a nose-like projection 60i constituting the lock bolt proper, adapted to engage the slideway 61i formed at the rear end of the movable plate 2i.

As in the preceding forms of embodiment, the case 40i is pivotally mounted about a vertical pivot member 41i carried by a base plate rigidly secured to the ski. Thus, the case 40i can pivot in a plane parallel to the top surface of the ski. However, it is normally urged to a position such that its longitudinal axis is coincident with the longitudinal axis of the ski. In this position, the pivot pin 47i extends across the ski axis.

The case 40i further comprises resilient means for both holding the case 40i in its above-defined normal position and retaining the tilting lever 48i also in its normal position. This mechanism comprises a single coil compression spring 45i disposed between a pair of pistons 44i and 50i. The first piston 44i is disposed at the rear and normally urged against a flat seat 43i formed at the front of the fixed pivot member 41i and extending transversely to the longitudinal axis of the ski.

Figure 18:
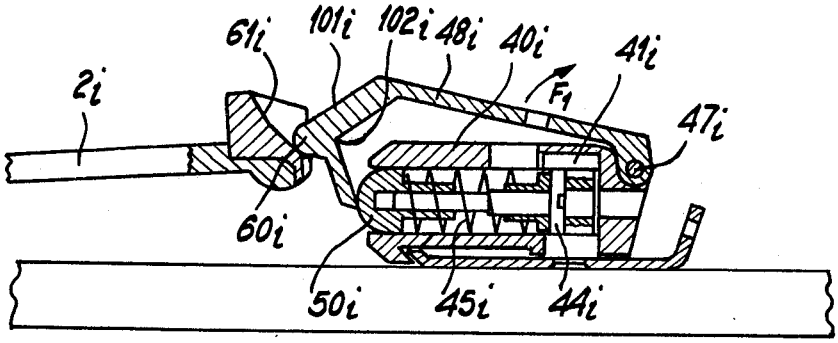
FIG. 18 is a fragmentary section similar to FIG. 15 showing on a different scale the safety ski binding of this invention during the lifting of the rear or heel end of the movable plate as a consequence of a vertical release movement.

The other piston 50i tends to project from the front end of case 40i and its front end has a part-spherical configuration normaly engaging the bottom of a cavity 102i formed on the rear face of the front portion 101i of the tilting lever 48i. In elevational view, as shown in FIG. 18, the bottom of said cavity is V-shaped and has its apex located forward. Thus, the pressure exerted by the spring-loaded piston 50i against the bottom of this cavity tends to hold the lever 48i in the lower position shown in FIG. 15. Now in this position, the nose-like projection 60i of said lever bears against the bottom of slideway 61i at the rear end of movable plate 2i, thus holding this plate on the ski.

However, when the rear or heel end of this plate is lifted, for instance in case of forward fall of the skier, the tilting lever 48i will pivot upwardly, in the direction of the arrow $F_1$ of FIG. 18, about the pivot pin 47i, if the effort thus exerted exceeds the resilient force of the spring 45i urging the piston 50i. In this case, the piston is caused to recede as illustrated in FIG. 18.

This mechanism also permits the pivotal movement of the case 40i in a horizontal plane (see arrow $F_2$, FIG. 17) for releasing the plate 2i when a sufficient torsional stress is exerted thereon. Thus mechanism will also permit a free movement of the lock-bolt forming case 40i in this plane. However, this mechanism is so constructed that it will also permit any other complex movements thereof for eventually releasing the movable plate 2i.

FIGS. 19 to 21 illustrate another modified form of embodiment of the retaining device holding the heel end of the movable plate on the ski. In this arrangement, the tilting locking lever 48j is fulcrumed about a pivot pin 47j disposed across the upper portion of the pivoting case 40j. This case 40j is pivotally mounted by means of a pair of trunnions 103j projecting from the lower and upper faces of the case and engaging corresponding apertures formed through a lower swivel plate 104j and through the upper wall 105j of a fixed case 106j.

As in the preceding examples, the pivoting case 40j encloses a spring-loaded mechanism for holding this case in its normal position and also the tilting lever 48j in its lower position. This mechanism comprises a single coil compression spring 45j prestressed between a pair of opposite pistons 44j and 50j.

The first piston 44j projects from the rear portion of case 40j and extends normally between a pair of cam faces 107 formed at the rear end of the aforesaid fixed case 106j. Said cam faces, as shown in horizontal section in FIG. 20, form together a V having its apex directed to the rear.

In this heel hold-down device, the pivoting case 40j is constantly urged to its normal position, i.e. in alignment with the longitudinal center line of the ski, due to the engagement of piston 44j between said cam faces 107j. However, this mechanism permits the pivotal movement of this case when a torsional effort of predetermined value is exerted against the lock bolt so that the piston 44j will slide along one or the other cam faces 107 while receding within the case 40j.

As to the piston 50j, it projects from the front end of case 40j and its front end comprises a rounded tip insert. The latter normally engages the bottom of a recess 102j formed in the rear face of the front portion of the tilting locking lever 48j. Under these conditions, this lever 48j is normally held in the position shown in dash and dot lines in FIG. 19.

However, when an effort tending to lift the heel end of the movable plate is exerted, this lever can tilt upwardly in the direction of the arrow $F_1$, as shown in FIG. 19, against the resilient pressure of the spring 45j urging the piston 50j.

It is an essential feature of the mechanism illustrated in FIGS. 19 to 21 to be particularly simpler and therefore more economical than the preceding ones disclosed in the foregoing. However, with this specific form of embodiment of the invention, it is nevertheless possible to provide very different values for the resilient force tending to counteract both a torsional release movement and a vertical release movement. In fact, although this mechanism comprises only one spring, these values are determined (a) by the angles formed between said cam faces 107 and the longitudinal axis of the ski and (b) by the specific configuration of the vertical contour of recess 102j. Therefore, this feature is particularly advantageous since in a safety ski binding of this type, different values should be given to the resilient forces counteracting these two release movements.

Although specific forms of embodiment of the present invention have been described, illustrated and suggested herein, it will readily occur to those conversant with the art that various modifications may be brought thereto without departing from the basic principles of the invention as set forth in the appended claims.

What is claimed as new is:

1. A safety ski binding comprising:

a plate adapted to act as a support means to a ski boot;

at the toe end and heel end of said plate, fastening means capable of holding the relevant end portions of said boot on said plate, respectively;

pivot means secured to the ski, and means for mounting said plate on said pivot means for permitting linear and pivotal movement of said plate from said normal position on said ski and for permitting detachment of said plate from said ski;

retaining means for normally retaining one end of said plate on said ski, said means being secured to the ski;

a pivot member secured to the ski surface adjacent the other end of said plate and extending upwardly from said surface;

a case rotatably mounted about said pivot member;

at least one resilient means in said case;

a lock bolt registering with said other end of said plate and pivotally mounted on said case for permitting vertical release of said plate;

said resilient means being substantially parallel to said ski surface and coacting with said lock bolt urging the lock bolt into a position parallel to said ski surface, and said resilient means further coacting with said pivot member for continuously urging said case toward a first position to hold said plate in parallel relationship with respect to the longitudinal axis of the ski;

a slideway in said plate for receiving said lock bolt, said slideway being longer than the part of said lock bolt registering with said slideway when said lock bolt is in said slideway and said plate is in its normal position on said ski to permit longitudinal movement of said plate on said ski, said slideway having one or more selectively shaped wall portions therein extending along the longitudinal direction of said slideway for controlling the vertical and horizontal release of said plate during excessive stress generated during skiing, the resilient means, the lock bolt and the slideway forming a resilient system for controlling movement of said plate toward said lock bolt.

2. A safety ski binding as set forth in claim 1, wherein the said wall portion of said slideway under said lock bolt is substantially parallel with the said lock bolt and ski surface when said plate is in its normal position, and said ski is not flexed, said wall further inclining away and upwards from said lock bolt over the remainder of its length, for causing said lock bolt to tilt upwardly against the opposing force of said resilient means when said plate moves longitudinally toward said lock bolt.

3. A safety ski binding as set forth in claim 2, wherein said pivot member for rotatably mounting said case comprises a bearing surface parallel to the axis of said pivot member and perpendicular to the ski axis, said resilient means comprises a coil compression spring housed longitudinally within said case, a piston mounted for axial sliding movement in said case, said coil compression spring urging said piston against the said bearing surface of said pivot member whereby, during the pivotal movement of said case in relation to said bearing surface, a torque counteracting said pivotal movement is created for returning said case to said first position.

4. A safety ski binding according to claim 3, wherein said lock bolt has a bearing surface also formed thereon, and said resilient retaining means includes a second coil compression spring, a second piston guided in the longitudinal direction in said rotating case, said second coil compression spring urging said second piston against the bearing surface of said bolt to provide a resilient system adapted to hold said lock bolt parallel to the surface of said ski whereby, when said lock bolt is tilted in relation to said case, said spring will provide a torque for counteracting this tilting movement.

5. A safety ski binding as set forth in claim 4, wherein the second coil compression spring is disposed between said lock bolt and said rotating case, and reacts against a bearing member, and means for adjusting said bearing member from outside of said binding.

6. A safety ski binding as set forth in claim 5, wherein said adjustable bearing member comprises a prismatic body mounted in said rotating case on a rotary shaft adapted to be driven from the outside and having its axis disposed eccentrically to that of said prismatic body.

7. A safety ski binding as set forth in claim 6, wherein said resilient means provided between said lock bolt and said rotating case, on the one hand, and between said rotating case and said pivot member, on the other hand, are disposed tandemwise in the longitudinal direction of the ski.

8. A safety ski binding as set forth in claim 6, wherein said resilient means disposed between said lock bolt and said rotating case, on the one hand, and between said rotating case and the pivot member, on the other hand, are disposed in superposed relationship.

9. A safety ski binding as set forth in claim 3, wherein said resilient means are assembled to constitute a single device whereby a single coil compression spring housed longitudinally in said rotating case is adapted to bear with one end against a second piston engaging a bearing surface of said lock bolt and with the opposite end against said piston engaging the said bearing surface of said pivot member.

10. A safety ski binding as set forth in claim 9, wherein one of said pistons comprises a rod extending longitudinally through said single coil compression spring and guided at its free end in a central cavity formed in the other piston, said rod comprising a screw-threaded portion engaged by a nut providing a bearing surface for said spring, whereby the force of said spring can be adjusted at will.

11. A safety ski binding as set forth in claim 10, wherein said adjustment nut is guided in said rotating case but held against rotation therein, the piston provided with said rod being the piston associated with the bearing surface of said pivot member, said piston being rotatably mounted about the axis of said rod, said case and pivot member having formed therethrough a hole opening into said case to permit the insertion of a screwdriver into a groove formed in the registering piston face for adjusting the force of said spring as required.

12. A safety ski binding as set forth in claim 9, wherein said lock bolt is carried by the front end of a pivoting lever fulcrumed to the upper portion of said case, said lock bolt comprising at its end adjacent to said plate a portion bent towards the underlying ski to form said second bearing surface, which surface registers with said second piston which protrudes from said rotating case, said lock bolt being responsive to said resilient retaining means housed within said rotating case.

13. a safety ski binding as set forth in claim 9, wherein said lock bolt is carried by the front end of a pivoting lever fulcrumed to the end portion of said rotating case which is opposite said movable plate, said lock bolt comprising at its end adjacent to said plate a portion bent towards the underlying ski to form said second bearing surface, which surface registers with said second piston which protrudes from said rotating case, said lock bolt being responsive to said resilient retaining means housed within said rotating case.

14. A safety ski binding as set forth in claim 3, wherein said lock bolt is carried by the front end of a pivoting lever fulcrumed to the upper portion of said rotating case, said lock bolt comprising at its end adjacent to said plate a portion bent toward the underlying ski to form a second bearing surface, which surface registers with a second piston which protrudes from said rotating case, said lock bolt being responsive to said resilient retaining means housed within said rotating case.

15. A safety ski binding as set forth in claim 14, wherein said lock bolt is mounted on said rotating case on a pivot pin which pin is disposed across the end of said pivoting case which is opposite said movable plate, said lock bolt extending in the longitudinal direction of the ski above said rotating case and throughout the length thereof.

16. A safety ski binding as set forth in claim 15, wherein said bearing surface of the front bent portion of said lock bolt comprises a recess engageable by said piston, said recess having a V-shaped contour with its apex directed away from said piston.

17. A safety ski binding as set forth in claim 14, wherein said bearing surface of the front bent portion of said lock bolt comprises a recess engageable by said piston, said recess having a V-shaped contour with its apex directed away from said piston.

18. A safety ski binding as set forth in claim 3, wherein said lock bolt is carried by the front end of a pivoting lever fulcrumed to the end portion of said pivoting case which is opposite said movable plate, said lock bolt comprising at its end adjacent to said plate a portion bent towards the underlying ski to form a second bearing surface, which surface registers with a second piston which protrudes from said rotating case, and is responsive to said resilient retaining means housed within said rotating case.

19. A safety ski binding as set forth in claim 3, wherein said lock bolt comprises an insert tip, and screw means for fitting said insert tip onto said lock bolt for permitting adjustment of the operative length of said lock bolt.

20. A safety ski binding as set forth in claim 1, wherein said lock bolt comprises an insert tip, and screw means for fitting said insert tip onto said lock bolt for permitting adjustment of the operative length of said lock bolt.

21. A safety ski binding as set forth in claim 1, wherein said slideway provided at the end of said detachable plate for receiving said lock bolt is formed in an insert block secured to said plate and adapted to be selectably positioned in the longitudinal direction thereof.

22. A safety ski binding as set forth in claim 1, wherein said lock bolt is pivotally mounted on said case on a horizontal pivot pin disposed perpendicularly to the longitudinal axis of the ski.

23. A safety ski binding comprising:

a plate adapted to act as a support means to a ski boot;

at the toe end and heel end of said plate, fastening means capable of holding the relevant end portions, of said boot on said plate, respectively;

pivot means secured to the ski, and means for mounting said plate on said pivot means for permitting linear and pivotal movement of said plate from said normal position on said ski and for permitting detachment of said plate from said ski;

means for normally retaining one end of said plate on said ski, said means being secured to the ski;

a pivot member secured to the ski surface adjacent the other end of said plate and extending upwardly from said surface;

a case rotatably mounted about said pivot member;

resilient means in said case comprising a first piston mounted for axial movement protruding from said case adjacent said other end of said plate, and a second piston mounted for axial movement protruding from the opposite side of said case, a coil compression spring mounted longitudinally between said first and second pistons;

a lock bolt registering with said other end of said plate, a pivoting lever fulcrummed to the upper portion of said case, the front end of said lever carrying said lock bolt; said lock bolt comprising at its end adjacent said plate, a portion bent towards the underlying ski to form a bearing surface which registers with said first piston forming a resilient system adapted to hold said lock bolt parallel to the surface of said ski, but permitting vertical release of said plate;

a pair of fixed cam faces forming a V in a plane parallel to said ski having its apex directed away from and registering with said second piston to form a resilient system for returning said case toward a first position to hold said plate in parallel relationship with respect to the longitudinal axis of the ski;

a slideway in said plate for receiving said lock bolt, said slideway being longer than the portion of said lock bolt registering with said slideway when said plate is in its normal position on an unflexed ski, a wall of said slideway being substantially parallel with said ski surface under said lock bolt and inclining away and upwards from said lock bolt over the remainder of its length, the inclining surface, the lock bolt and resilient means forming a resilient system for controlling the movement of said plate toward said lock bolt;

a bearing member adjustable from the outside adapted to react against said coil compression spring and adjust the value of the force of said spring against both of said pistons.

* * * * *